United States Patent [19]

Graf et al.

[11] 4,320,270

[45] Mar. 16, 1982

[54] GAS-BLAST SWITCH

[75] Inventors: Rudolf Graf, Obermuhen; Christian Sturzenegger, Zurich, both of Switzerland

[73] Assignee: Sprecher & Schuh AG, Aarau, Switzerland

[21] Appl. No.: 120,391

[22] Filed: Feb. 11, 1980

[30] Foreign Application Priority Data

Apr. 12, 1979 [CH] Switzerland ..... 3511/79

[51] Int. Cl.[3] ..... H01H 33/88

[52] U.S. Cl. ..... 200/148 A

[58] Field of Search ..... 200/148 A

[56] References Cited

U.S. PATENT DOCUMENTS 3,679,851 7/1972 Latour et al. ..... 200/148 A

*Primary Examiner*—Robert S. Macon

*Attorney, Agent, or Firm*—Werner W. Kleeman

[57] ABSTRACT

A gas-blast switch having a movable contact element and a stationary contact element and a blast nozzle operatively associated with one of the contact elements and surrounding the same. The blast nozzle, during the course of the cut-off stroke of the gas-blast switch, is connected with a pump chamber or compartment which can be placed under pressure. The nozzle chamber is constituted by an inlet space converging towards the nozzle throat and an outlet space diverging away from such throat. In the blast nozzle there are additionally formed channels which flow communicate with the pump chamber. These channels open at an angle with respect to the nozzle axis into the nozzle chamber in order to additionally cause a blowing of the arc transversely in addition to the axial blowing of the arc in the blast nozzle. To obtain as low as possible flow losses of the extinguishing gas flowing through the channels, the latter are structured in the form of inwardly open grooves which extend essentially axially or obliquely with respect to the lengthwise axis of the blast nozzle and start from the converging inlet space or chamber. The base of the grooves extends linearly or is curved in the manner of guide buckets or blades and has a starting portion extending in the inlet space essentially parallel to the flow direction as well as an end section directed towards the nozzle axis and arranged downstream of the throat.

8 Claims, 1 Drawing Figure

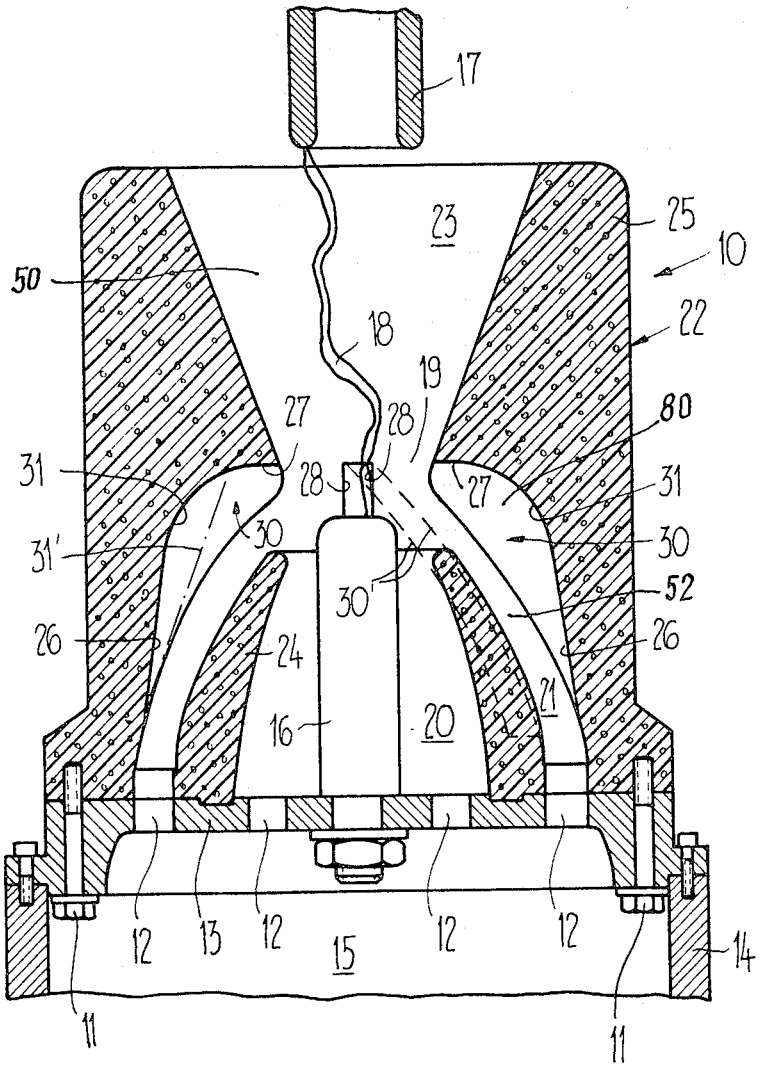
17
23
25
10
50
22
18
19
80
27
28
28
27
31
31
30
31'
30
30'
52
26
24
26
21
16
20
12
13
12
12
12
15
14
11
11

GAS-BLAST SWITCH

BACKGROUND OF THE INVENTION

The present invention relates to a new and improved construction of gas-blast switch.

Generally speaking, the gas-blast switch of the present development is of the type comprising a movable contact element and a stationary or fixed contact element. A blast nozzle connected with a pump chamber which can be pressurized during the course of the cut-off stroke of the gas-blast switch is operatively associated with one of the contact elements. Such blast nozzle surrounds the related contact element and its nozzle chamber has an inlet space converging towards the nozzle throat and an outlet space diverging away from the nozzle throat. In the blast nozzle there are formed channels which flow communicate with the pump chamber. These channels open at an angle with respect to the nozzle axis into the nozzle space or chamber.

Such type gas-blast switches are known, for instance, from German Patent Publication No. 2,710,868 and U.S. Pat. No. 3,946,180. The channels formed in the blast nozzle and flow communicating with the pump chamber and opening at an angle with respect to the nozzle axis into the pump chamber are assigned the task of producing a transverse blowing of the cut-off arc burning in the nozzle chamber in addition to the axial blowing of the arc which is accomplished during the cutoff stroke of the gas-blast switch. This affords an efficient cooling of the arc, particularly at the region of the throat of the blast nozzle. This improved cooling also contributes to preventing any "clogging" of the blast nozzle by heated arc plasma, which, in turn, appreciably impairs the axial blowing of the arc.

With the heretofore known gas-blast switches of this type, the channels are formed by bores which are machined or otherwise formed to extend through the nozzle body and ultimately open at the region of the nozzle throat or also shortly before such nozzle throat or thereafter into the nozzle chamber or space. If the strived for transverse blowing of the arc should be adequately effective, then there must be provided for this purpose also a sufficient quantity of extinguishing gas. However, in order to propel an adequate quantity of extinguishing gas through the bores of the blast nozzle of the heretofore known gas-blast switches, it is necessary to provide a large number of bores and/or the volume of the pump chamber and the drive which pressurizes the same must be correspondingly largely dimensioned, because the extinguishing gas, during such time as it flows through the bores, loses an appreciable part of its kinetic energy. This is particularly so in those instances, as taught in U.S. Pat. No. 3,946,180, where the bores have an angled extent or course of travel.

SUMMARY OF THE INVENTION

Therefore, with the foregoing in mind, it is a primary object of the present invention to provide a new and improved construction of gas-blast switch which is not afflicted with the aforementioned drawbacks and shortcomings of the prior art proposals.

Another and more specific object of the present invention aims at providing a new and improved construction of gas-blast switch of the aforementioned type wherein the gas withdrawn out of the pump chamber for the transverse blowing of the arc is deflected, with the least possible loss in kinetic energy, in the desired blowing direction, in order to achieve the beneficial result that for a given volume of the pump chamber and dimensioning of the drive the efficiency is increased, both in axial and also in transverse direction.

Yet a further significant object of the present invention aims at a new and improved construction of gas-blast switch which is relatively simple in design, economical to manufacture, extremely reliable in operation, not readily subject to breakdown or malfunction, requires a minimum of maintenance and servicing and affords positive and good extinguishing of the arc.

Now in order to implement these and still further objects of the invention, which will become more readily apparent as the description proceeds, the gas-blast switch of the present development is manifested by the features that the aforementioned channels are formed by inwardly opening grooves which emanate from the converging inlet chamber or space. The base of the grooves has a starting section or portion arranged downstream with respect to the direction of the flow of the extinguishing gas and extending essentially parallel to the flow direction in the inlet chamber. The base of the grooves further has a terminal section which is arranged downstream of the throat of the blast nozzle and directed towards the nozzle axis.

BRIEF DESCRIPTION OF THE DRAWING

The invention will be better understood and objects other than those set forth above will become more apparent when consideration is given to the detailed description thereof. Such description makes reference to the annexed drawing wherein the single figure of the drawing shows in fragmentary axial sectional view details of a gas-blast switch constructed according to the invention wherein as a matter of simplification in the showing only the most important parts of the gas-blast switch have been shown.

DETAILED DESCRIPTION OF THE PREFERRED EMBODIMENTS

Describing now the drawing, in the single figure there is schematically illustrated a gas-blast switch 10 containing a substantially tubular shaped, stationary contact element 17. This contact element 17, in the cut-on position of the gas-blast switch, engages by means of its inner diameter or surface with the outer diameter or surface of a movable contact element 16. The movable contact element 16 is threadably or otherwise connected with a metallic closure flange 13 of a pump cylinder 14 surrounding a pump chamber or compartment 15. The pump cylinder 14 is displaceably guided upon a conventional and therefore not particularly shown stationarily supported piston and coupled with a likewise conventional and not shown switch drive.

By means of threaded bolts 11 or other equivalent fastening devices a blast nozzle 22, formed of an electrically insulating material, is secured to a side of the flange 13 facing away from the pump chamber 15. The blast nozzle 22 has a nozzle chamber 50 which is constituted by an inlet space 52 converging in the direction of the nozzle throat 19 and an outlet space 23 diverging away from the nozzle throat 19. By means of a partition body 24, likewise anchored in appropriate fashion at the flange 13, and formed of the same material as the blast nozzle 22, the inlet space 52 is subdivided into an inner jacket space or chamber 20 and an outer jacket space or chamber 21. Both the inner jacket space 20 and the outer jacket space 21 flow communicate with the pump chamber 15 by means of passages or bores 12 or equivalent structure formed in the flange 13.

Emanating from the outer jacket space or chamber 21 of the inlet space 52 of the blast nozzle 22 are a number of channels 80 configured in the form of essentially axially extending inwardly opening grooves 30. As will be seen from the drawing, the base 31 of the grooves 30 has approximately the shape of a continuously curved guide bucket or blade. The upstream situated starting portion or section 26 of the base 31 of each groove 30 extends approximately parallel to the nozzle axis and the downstream situated terminal or end section 27 approximately at right angles to such nozzle axis. The sidewalls 28 of the grooves 30, in the embodiment under discussion, are essentially parallel to one another, i.e. the width of the grooves 30 is constant over their entire depth and length. Advantageously, the sum of the width of all of the grooves 30 amounts to less than one half of the inner circumference of the nozzle throat 19. The end section of the base of each groove advantageously encloses an angle of about 10° to 90° with respect to the lengthwise axis of the blast nozzle.

However, it is also possible to impart to the grooves 30 a substantially trapezoidal flow cross-sectional configuration which widens towards the inside.

In the cut-on position of the gas-blast switch, as mentioned, the stationary contact element 17 engages, by means of its inner diameter or inner surface with the outer diameter or surface of the movable contact element 16. The outer diameter of the fixed or stationary contact element 17 on the other hand, bears practically in a snug or sealing fashion at the nozzle throat 19 and therefore closes the blast nozzle 22 and also the end section or portion of the grooves 30.

During the cutoff stroke of the gas-blast switch the pump chamber 15 is placed under pressure and only when the narrowest portion or throat 19 of the blast nozzle 22 has departed from the fixed contact element 17 is there formed a blast current or stream which extends essentially in axial direction. This blast stream is placed into a turbulent or intensive flow at the nozzle throat 19 by the action of the gas deflected by the floor or base portion 31 of the grooves 30 and to a certain extent is constricted, so that the switching arc 18 which is drawn between the contact elements 16 and 17 is not only intensively blown with extinguishing gas, but is also held remote from the inner wall of the nozzle chamber. The blowing of the arc in transverse direction, i.e. by means of the grooves 30, is first initiated with the axial blast stream or current of extinguishing gas, so that there is prevented any premature consumption of pressurized gas out of the pump chamber 15, and additionally, the gas flowing through the grooves 30 practically experiences no loss in kinetic energy.

With the embodiment shown in full lines, the grooves 30 extend essentially parallel to the axis of the blast nozzle 22 and the base or floor 31 of each of the grooves is domed or curved in a guide bucket or blade-like fashion. According to another embodiment, the inwardly open grooves 30—as indicated with the phantom lines 30'—describe a section of a helix line having large pitch, exceeding approximately 50°. In this way there is beneficially achieved the result that the transverse blowing of the gas stream at the region of the throat 19 additionally has imparted thereto a twist, by means of which the switching arc 18 is caused to twist or revolve.

With a still further embodiment of the invention, the groove base of the grooves 30 which are open towards the inside, extend linearly, as shown at the left-hand side of the drawing by the phantom lines 31'.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A gas blast switch, comprising:

a movable contact element;

a stationary contact element cooperating with the movable contact element;

a blast nozzle operatively associated with one of the contact elements;

said blast nozzle having a nozzle chamber comprising a converging inlet portion, a throat and a diverging outlet portion;

means defining a pump chamber for an extinguishing gas which can be pressurized during the course of a cut-off stroke of the gas-blast switch;

said inlet portion of said blast nozzle being connected with said pump chamber;

said blast nozzle surrounding the related contact element;

channel means formed in said blast nozzle and flow communicating with the pump chamber;

said channel means opening at an angle with respect to the lengthwise axis of the blast nozzle into the nozzle chamber;

said channel means comprising inwardly open grooves starting at the region of the converging inlet portion;

each of said grooves having a bottom;

each groove bottom having a starting portion arranged upstream of the flow direction of the extinguishing gas and extending in the inlet portion essentially parallel to the flow direction of the extinguishing gas; and each groove bottom having an end section which is arranged in the region of the nozzle throat and is directed towards the lengthwise axis of the blast nozzle.

2. The gas blast switch as defined in claim 1, wherein: the bottom of each groove has a lengthwise domed configuration in a guide-blade-like fashion.

3. The gas blast switch as defined in claim 1, wherein: the bottom of each groove extends essentially linearly.

4. The gas blast switch as defined in claim 1, wherein: the grooves extend essentially axially.

5. The gas-blast switch as defined in claim 1, wherein: the grooves describe a helix section having a pitch exceeding 50°.

6. The gas-blast switch defined in claim 1, wherein: each of the grooves have side walls extending essentially parallel to one another.

7. The gas-blast switch as defined in claim 1, wherein: each of the grooves are essentially of the same dimension and are arranged at a substantially uniform angular spacing about the lengthwise axis of the blast nozzle.

8. The gas-blast switch as defined in claim 1, wherein: said end section of the bottom of each of the grooves encloses with the lengthwise axis of the blast nozzle an angle in the order of between about 10° and 90°.

* * * * *